US007043956B2

(12) United States Patent
Higuchi et al.

(10) Patent No.: US 7,043,956 B2
(45) Date of Patent: May 16, 2006

(54) MODULE CAM AND METHOD FOR ALIGNING AND FASTENING TOOL

(75) Inventors: Masahiro Higuchi, Tokyo (JP); Hiroo Mishima, Tokyo (JP); Shoji Nemoto, Tokyo (JP)

(73) Assignee: Sankyo Oilless Industry, Inc., Tokyo (JP)

( * ) Notice: Subject to any disclaimer, the term of this patent is extended or adjusted under 35 U.S.C. 154(b) by 218 days.

(21) Appl. No.: 10/729,912

(22) Filed: Dec. 9, 2003

(65) Prior Publication Data

US 2004/0163440 A1 Aug. 26, 2004

(30) Foreign Application Priority Data

Feb. 21, 2003 (JP) ..... 2003-044374

(51) Int. Cl.
*B21J 9/18* (2006.01)
*B26D 5/08* (2006.01)

(52) U.S. Cl. ..... 72/452.9; 72/315; 83/627; 83/635

(58) Field of Classification Search ..... 72/452.8, 72/452.9, 315; 83/627, 635
See application file for complete search history.

(56) References Cited

U.S. PATENT DOCUMENTS

| | | | | |
|---|---|---|---|---|
| 5,101,705 A * | 4/1992 | Matsuoka | ..... | 72/452.9 |
| 5,231,907 A * | 8/1993 | Matsuoka | ..... | 72/452.9 |
| 6,220,137 B1 * | 4/2001 | Matsuoka | ..... | 72/452.9 |

FOREIGN PATENT DOCUMENTS

| | | | | |
|---|---|---|---|---|
| JP | 58-138-527 | * 8/1983 | ..... | 72/452.9 |
| JP | 58-202291 | * 11/1983 | ..... | 72/452.9 |
| JP | 2002-143944 | 5/2002 | | |

* cited by examiner

*Primary Examiner*—David Jones
(74) *Attorney, Agent, or Firm*—Wenderoth, Lind & Ponack, L.L.P.

(57) ABSTRACT

To facilitate aligning and setting of a punch in a die of a press machine, a module cam assembly comprises a cam unit and an L-shaped module base. The cam unit comprises a cam driver, a cam slider equipped with a positive return to be driven by the cam driver, and a cam base holding the cam slider. The cam slider has a punch retainer on its vertical side. The L-shaped module base bears the cam unit, and is adapted to be fastened to the lower die holder. The L-shaped module base has a button die on its vertical leg in confronting relation with the punch retainer of the cam slider. This arrangement facilitates the centering and fastening of any tool to the press machine.

3 Claims, 7 Drawing Sheets

MODULE CAM AND METHOD FOR ALIGNING AND FASTENING TOOL

BACKGROUND OF THE INVENTION

1. Field of the Invention

The present invention relates to a module cam assembly and a method for aligning and fastening a tool to the module cam assembly. The module cam assembly is detachably sandwiched between the upper and lower die holders of a press machine.

2. Related Art

Referring to FIG. 6, when it is desired to bend and punch work pieces using a variety of metal molds (dies) respectively having upper halves and lower halves, it is known to install a cam unit between the upper and lower die holders of a press machine. The cam unit comprises a vertically movable cam driver 22 fixed to an upper die holder 21, a horizontally movable cam slider 23 slidably connected to the cam driver 22, a positive return 24 having a resilient member responsive to the rise of the cam driver 22 for driving the cam slider 23 to the original position, and a lower die holder 25 slidably supporting the cam slider 23. The cam driver 22 has a downward cam slope, and the cam slider 23 has an upward cam slope. The cam driver 22 and the cam slider 23 are combined together with their slopes put in contact each other, so that raising and lowering of the cam driver 22 may move the cam slider 23 back and forth. The cam slider 23 is biased toward its original position in which the cam driver 22 is raised to its upper dead point, and the cam slider 23 is responsive to the rise of the cam driver 22 for moving back to the original position.

The cam slider 23 has, for example, a punch 26 fastened to its vertical side for piercing work pieces, whereas the lower holder 25 has a die 27 fastened to its vertical side corresponding to the punch 26. Such tool parts are aligned with each other to assure side piercing or side cutting of work pieces.

The above dies (cam unit) are massive and heavy and accordingly the cam driver, the cam slider and the cam base, a part of the lower die, are combined as a cam unit in order to improve its adaptability to a variety of machining of work pieces. For example, a known compact cam unit 28 that is narrow in width as shown in FIGS. 7A and 7B, comprises a cam driver 28*a*, a cam slider 28*b*, a cam base 28*c*, and a positive return 28*d*. The cam unit 28 is of a "horizontal" (die-mounted) type. As shown in FIGS. 8A and 8B, another cam unit 29 comprises a cam driver 29*a*, a cam slider 29*b*, and a cam base 29*c*, which is upside down compared to the above cam unit 28. The cam slider 29*b* is equipped with a positive return 29*d*. The so assembled cam unit 29 is of a "flying" (aerial) type.

Such a cam unit, however, is useless in reducing the difficulty in aligning and fastening a tool such as the punch 26 and die 27 in an exact position. The cam unit is fixedly set on the lower die holder 25, and the upper die holder 21 is raised or lowered slowly and by degrees to control the horizontal movement of the cam slider 23 until the die 27 and the punch 26 are put exactly in alignment. When aligned, the punch 26 and die 27 are tentatively fixed to the stationary and movable parts of the press machine. Then, the upper die holder 21 is raised up to the upper dead point, and the punch 26 and die 27 are fixed in position. The upper holder 21 is lowered to the lower dead point to check if the punch 26 and die 27 are aligned with each other. Usually this centering sequence is repeated until these tool parts are put exactly in alignment. JP2002-143944 (A) proposes use of a key in aligning tool parts.

As mentioned above, the aligning-and-setting work is very tedious, requiring the raising and lowering of the upper die holder for putting tool parts exactly in alignment.

One object of the present invention is to provide a module cam assembly facilitating the aligning and setting of tool parts.

Another object of the present invention is to provide a method of aligning and attaching tool parts to the stationary and movable parts of a press machine.

SUMMARY OF THE INVENTION

To attain these objects a module cam assembly to be sandwiched between upper and lower die holders of a pressing apparatus according to the present invention comprises: a cam unit comprising a cam driver, a cam slider to be driven by the cam driver, the cam slider having a punch retainer on its vertical side, and a cam base holding the cam slider; and a monolithic L-shaped module base bearing the cam unit, and being adapted to be laid and fastened to the lower die holder, the L-shaped module base having a button die on its vertical leg in confronting relation with the punch retainer of the cam slider.

Also, a method of adjustably fixing a punch and a button die to a press machine in exact alignment according to the present invention comprises steps of: preparing a module cam assembly as described above; fastening the punch to the punch retainer of the cam slider and the button die of the upright leg of the L-shaped module base to be aligned with each other in confronting relation; and putting and fastening the module cam assembly having the punch and button die fixed in position on the lower die holder of the press machine.

In setting, for example, a punch and a die in the press machine, first, these tool pieces are fixed to the punch retainer of the cam slider and to the button die of the upright leg of the L-shaped module base, and the module cam assembly is set on the lower holder of the press machine. Thus, the tedious and time-consuming work, which otherwise would be required in situ, is made unnecessary.

The cam unit can be moved back and forth on the horizontal leg of the L-shaped module base, thereby adjusting the distance between the retainer of the cam slider and the button die of the upright leg of the L-shaped module base in respect of the length of the punch.

Other objects and advantages of the present invention will be understood from the following description of module cam assemblies according to some preferred embodiments of the present invention, which are shown in accompanying drawings.

DETAILED DESCRIPTION OF PREFERRED EMBODIMENTS

Figure 1:
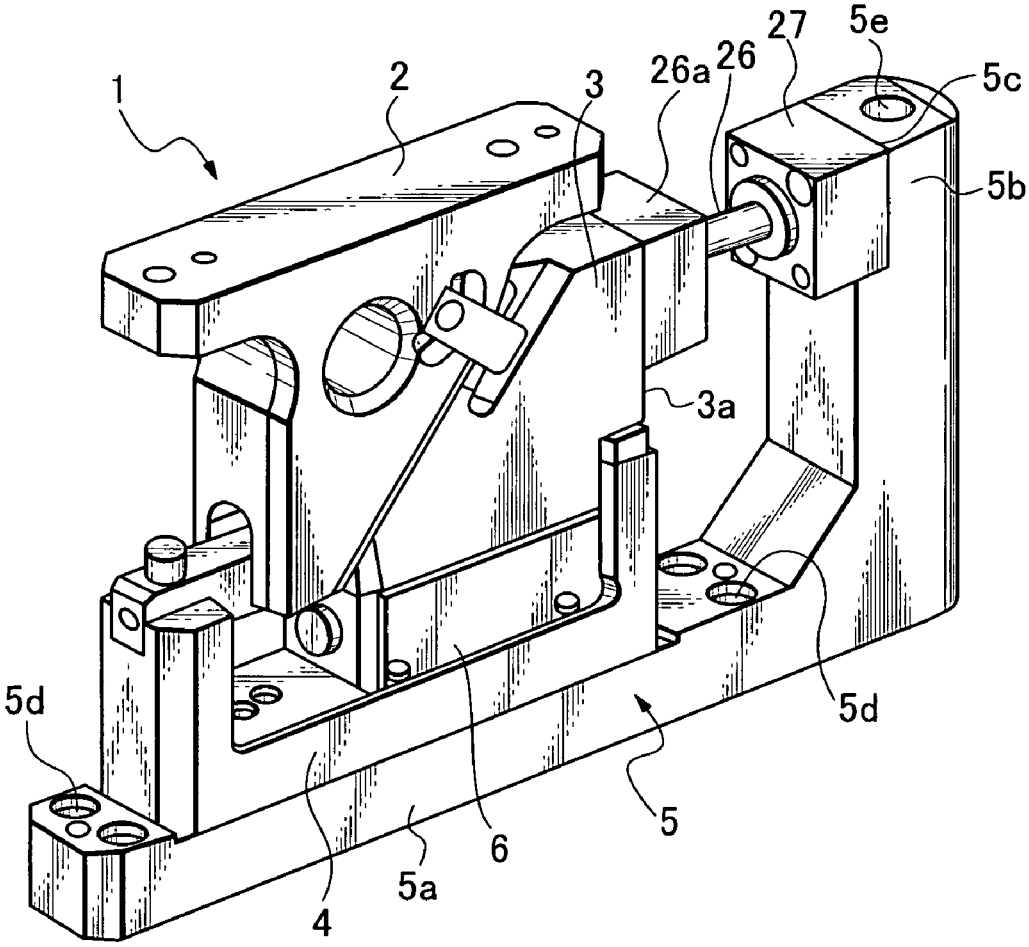
FIG. 1 is a perspective view of a module cam assembly according to a first embodiment of the present invention.

Referring to FIGS. 1 and 2, a module cam assembly 1 according to the first embodiment of the present invention is of the horizontal type. It comprises a vertically movable cam driver 2, a horizontally movable cam slider 3 to be horizontally driven by the cam driver 2, a cam base 4 slidably holding the cam slider 3, and a L-shaped module base 5 integrally connected to the cam base 4. These parts are arranged from top to bottom in the order named. The cam driver 2 has a downward slope, whereas the cam slider 3 has an upward slope. The cam driver 2 rides on the cam slider 3 with their slopes abutting on each other. A positive return 6 is provided between the cam slider 3 and the cam base 4. The cam driver 2, cam slider 3, positive return 6 and cam base 4 together make up a cam unit, which is the same as the conventional horizontal type of cam unit. No further description, therefore, is required.

Figure 2A:
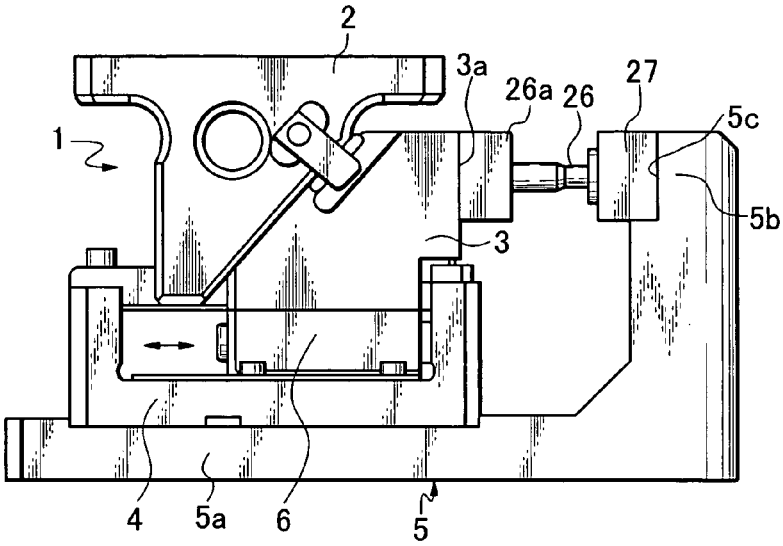
FIGS. 2A, 2B, 2C and 2D are front, side, plan and bottom views of the module cam assembly of FIG. 1.
Figure 2B:
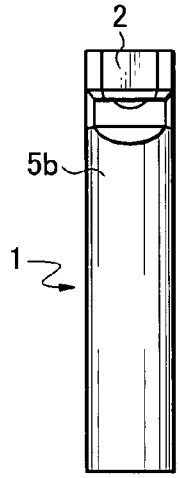
Figure 2C:
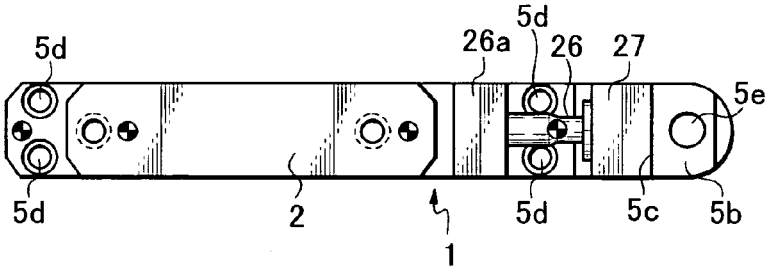
Figure 2D:
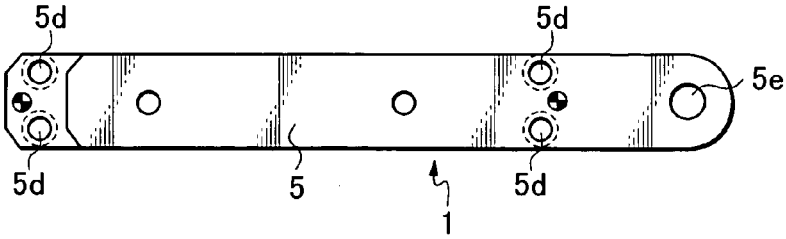

The L-shaped module base 5 is the essential part of the present invention, and it comprises a horizontal leg 5*a* and an upright leg 5*b* integrally connected to the end of the horizontal leg 5*a* such that the L-shaped module base is monolithic as shown in FIGS. 1 and 2A. The upright leg 5*b* stands parallel to the vertical side 3*a* of the cam slider 3. The vertical side 3*a* has a retainer 26*a* fixed thereto. The upright leg 5*b* has a mounting area 5*c* in confronting relation with the retainer 26*a* of the cam slider 3.

Specifically the mounting area 5*c* has tapped holes to fasten a die 27 by screwing bolts. A punch 26 is firmly held by the retainer 26*a* on the cam slider 3. The upright leg 5*b* has a through hole 5*e* for removing the remains of work pieces after being punched (see FIGS. 1, 2C and 2D).

The die 27 is loosely bolted and tentatively fastened to the mounting area 5*c* of the upright leg 5*b*, and likewise, the retainer 26*a* is loosely bolted and tentatively fastened to the cam slider 3.

To center the punch 26 with respect to the die 27, the cam slider 3 is pushed forward against the resilient force of the positive return 6, and the punch 26 is inserted in the die 27, and then, the retainer 26*a* and die 27 are fastened to the cam slider 3 and the upright leg 5*b* for example, by means of an instantaneous adhesive agent such as AronAlpha (trademark). Then, the cam slider 3 is allowed to return to its original position, and the punch 26 is pulled out of the die 27, and the screws are tightened to fasten the retainer 26*a* and the die 27 to the cam slider 3 and the upright leg 5*b*, respectively.

Thus, the module cam assembly 1 has the punch 26 and the die 27 fastened exactly in alignment, and the module cam assembly 1 is brought and laid on the lower die holder 25 of the press machine in situ. Then, bolts are inserted in the holes 5*d* of the module base 5 to be driven into the tapped holes of the lower die holder 25 of the press machine.

Thus, the centering can be attained without the tedious adjustment; slowly and by degrees raising and lowering the upper die holder 21 between its upper and lower dead points to move the module cam assembly 1 back and forth, and hence the punch toward or away from the die. Elimination of the tedious, time-consuming alignment effectively improves the working efficiency.

Figure 3:
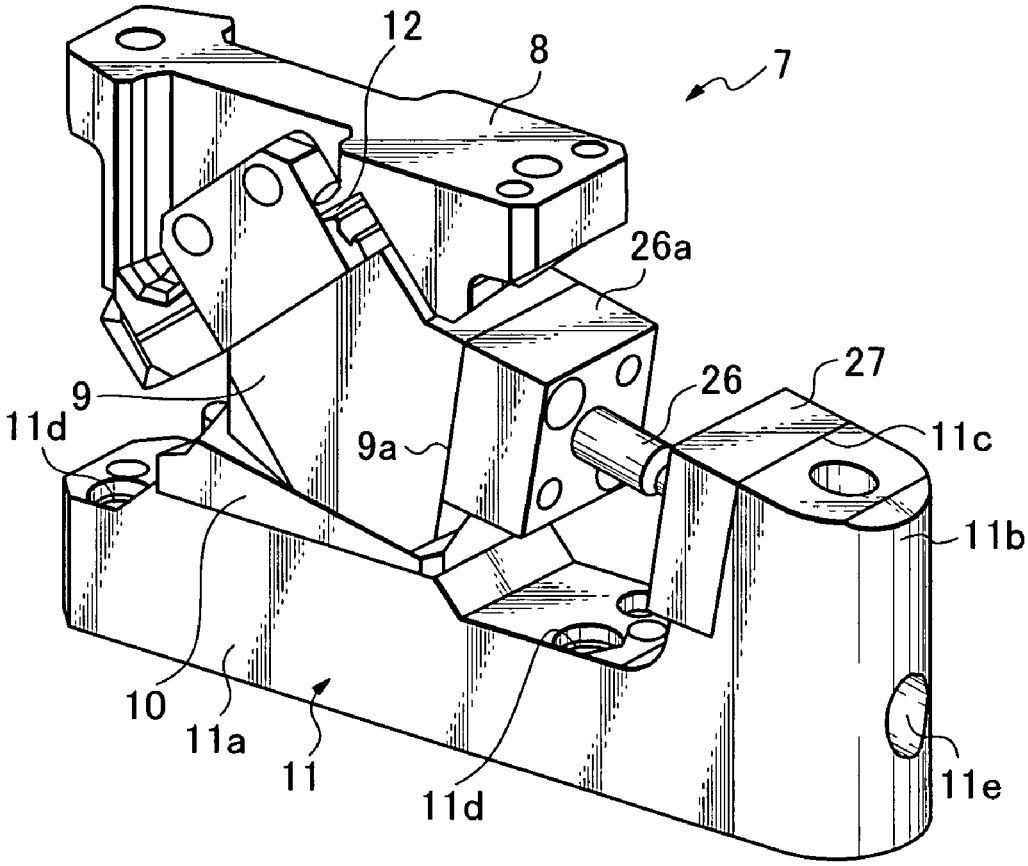
FIG. 3 is a perspective view of a module cam assembly according to a second embodiment.
Figure 4A:
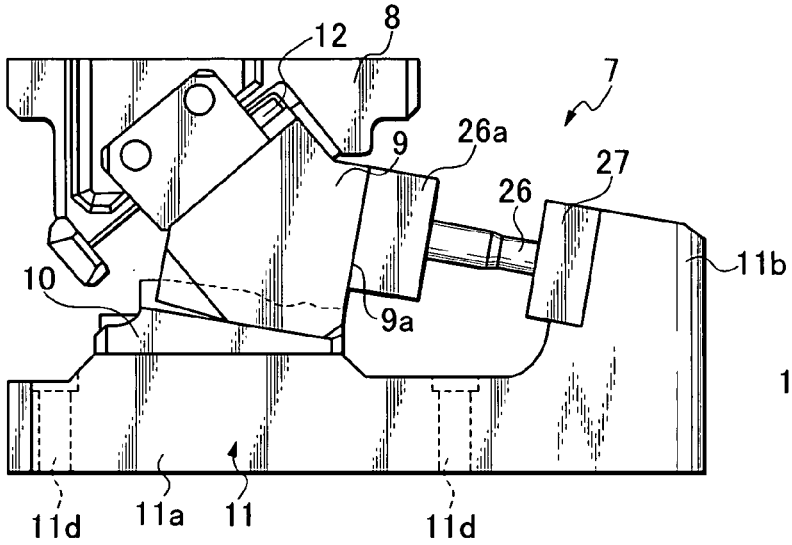
FIGS. 4A, 4B, 4C and 4D are front, side, plan and bottom views of the module cam assembly of FIG. 3.
Figure 4B:
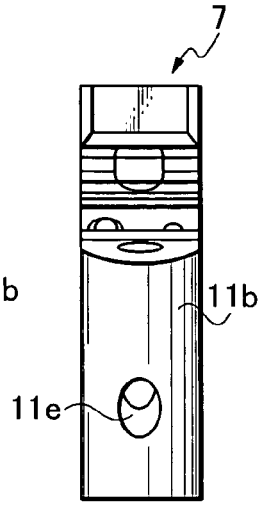
Figure 4C:
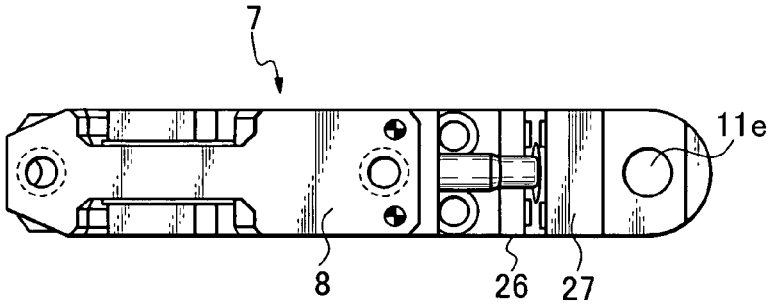
Figure 4D:
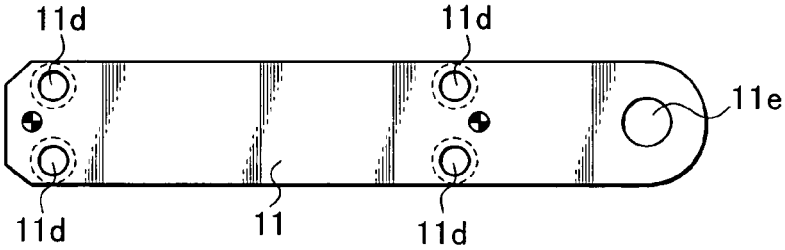

Referring to FIGS. 3 and 4A–4D, a module cam assembly 7 according to the second embodiment is of the flying (aerial) type. It comprises a cam base 8, a cam slider 9, a cam driver 10, and an L-shaped module base 11 arranged from top to bottom in the order named. A positive return 12 is provided between the cam base 8 and the cam slider 9. The L-shaped module base 11 comprises a horizontal leg 11*a* and an upright leg 11*b* integrally connected to the end of the horizontal leg 11*a* such that the L-shaped module base 11 is monolithic as shown in FIGS. 3 and 4A. The upright leg 1*b* has a mounting surface area 1*c* parallel to the confronting side 9*a* of the cam slider 9, on which is fixed a retainer 26*a* having a punch 26 held at its center. The die 27 is fixed to the mounting surface area 11*c* of the upright leg 11*b*. The punch 26 can be centered relative to the die 27 in the same way as in the first embodiment.

Figure 5:
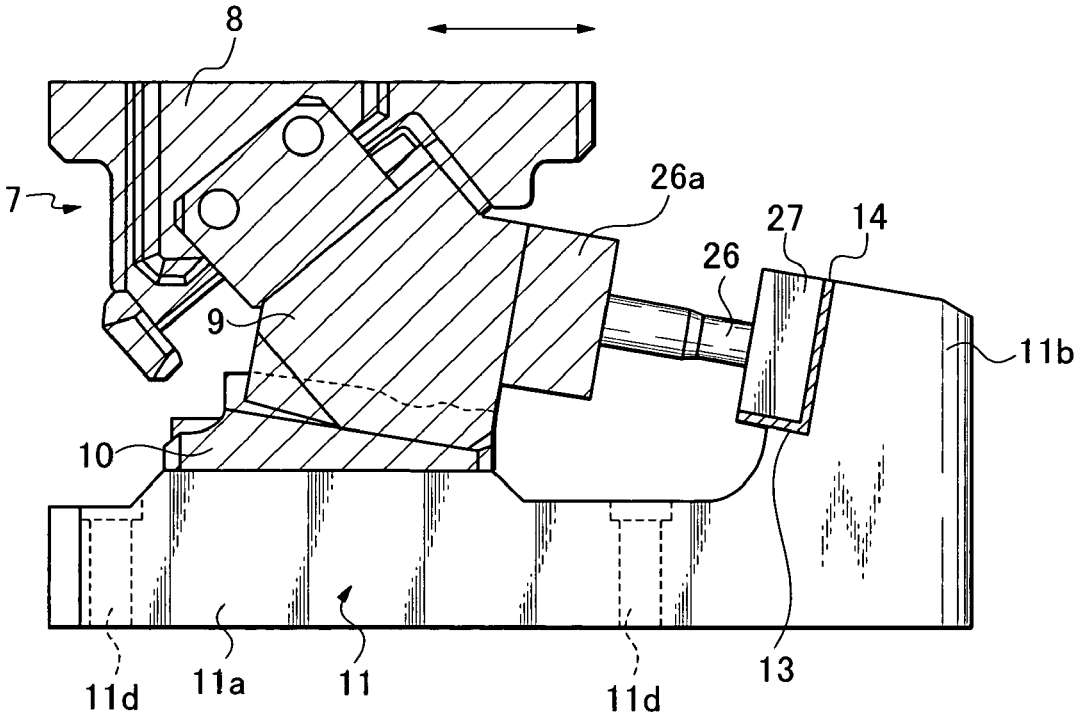
FIG. 5 is a front view partially in section of a module cam assembly according to a third embodiment.
Figure 6:
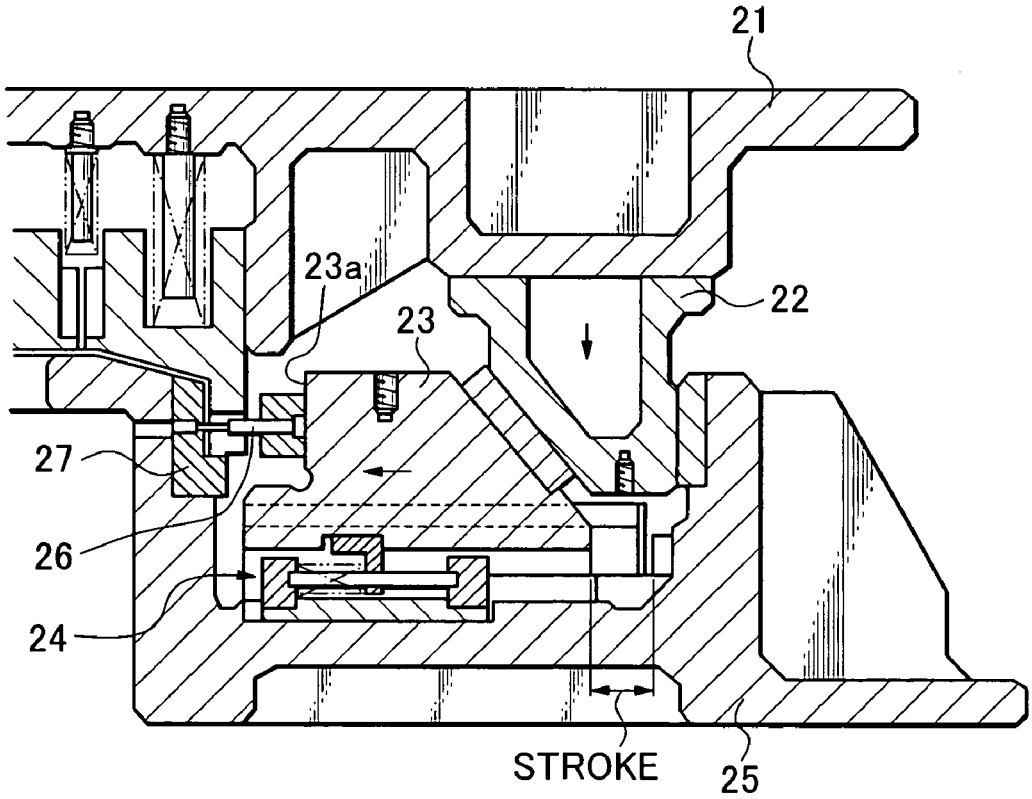
Fig. 6 PRIOR ART
FIG. 6 is a front sectional view of a conventional cam unit assembly assembled with upper and lower dies.
Figure 7A:
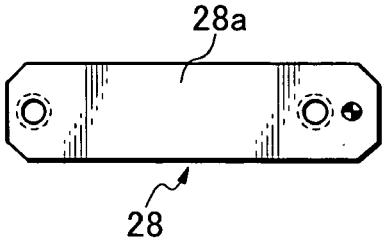
Fig. 7(A) PRIOR ART
FIGS. 7A and 7B are plan and front views of a conventional cam unit.
Figure 7B:
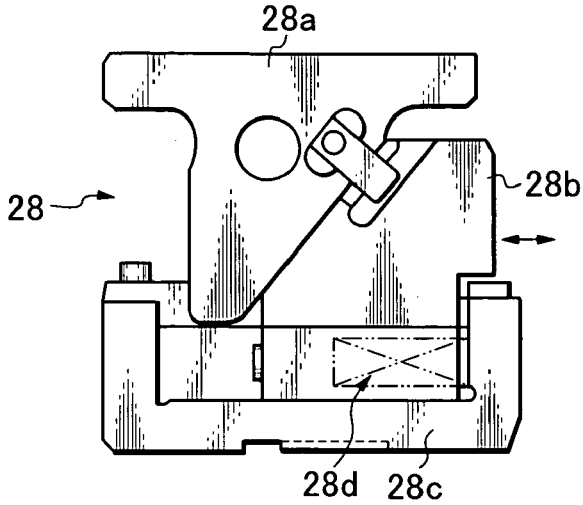
Fig. 7(B) PRIOR ART
Figure 8A:
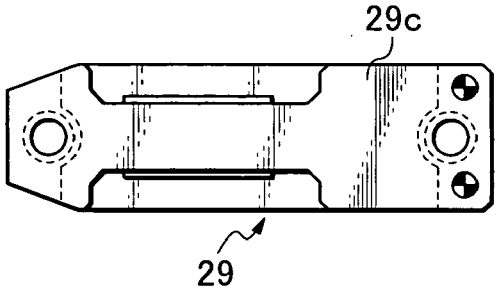
Fig. 8(A) PRIOR ART
FIGS. 8A and 8B are plan and front views of another conventional cam unit.
Figure 8B:
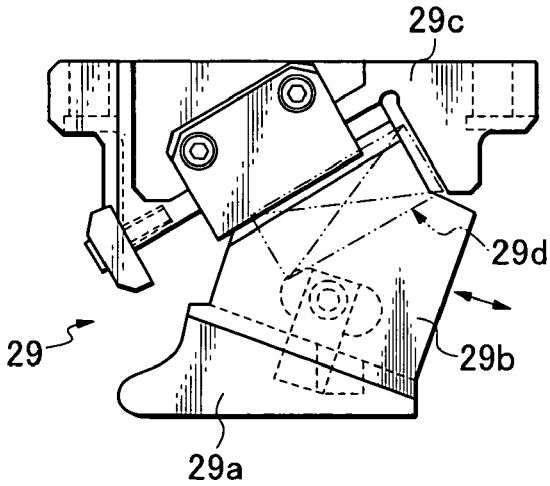
Fig. 8(B) PRIOR ART

FIG. 5 shows a module cam assembly 7 according to the third embodiment. A cam base 8, a cam slider 9, and a cam driver 10 together make up a cam unit (shaded in the drawing) that can be moved on a monolithic L-shaped module base 11 so that its horizontal position may be adjusted. This arrangement permits selective use of punches 26 whose length may vary, for example, from 70 to 100 millimeters.

For this purpose the L-shaped module base 11 may have a series of mounting holes made at intervals on its horizontal leg 11*a* for bolting the cam unit assembly 7*a* at a controlled position. Otherwise, the cam driver 10 is designed to be slidable on the L-shaped module base 11, permitting the continuous positional adjustment in respect of the length of the used punch. The horizontal type of module cam assembly 1 according to the first embodiment may be designed to permit the continuous positional adjustment of the cam unit in respect of the length of the used punch.

The die 27 can be adjusted vertically in position by using a shim 13, thereby compensating for the vertical change caused by the length of the used punch. Likewise, the die 27 can be adjusted horizontally in position by using another shim 14.

As may be understood from the above, the centering can be easily performed in the module cam assembly, and the module cam assembly having its tool parts aligned in position is brought to, laid on and fastened to the lower die holder of the press machine in situ. Thus, the tedious, time-consuming work is not required for centering in situ. This contributes to improvement of the working efficiency.

What is claimed is:

1. A module cam assembly to be mounted between upper and lower die holders of a press machine, the module cam assembly comprising:

a cam unit comprising a cam driver, a cam slider to be driven by the cam driver, the cam slider having a vertical side with a punch retainer thereon, and a cam base holding the cam slider; and a monolithic L-shaped module base bearing the cam unit, and being adapted to be laid on and fastened to the lower die holder, the monolithic L-shaped module base having an upright leg with a button die thereon in confronting relation with the punch retainer of the cam slider.

2. A method of adjustably fixing a punch and a button die to a press machine in exact alignment, comprising:

preparing a module cam assembly according to claim 1;

fastening the punch to the punch retainer of the cam slider and the button die of the upright leg of the monolithic L-shaped module base to be aligned with each other in confronting relation; and putting and fastening the module cam assembly having the punch and the button die thus fixed in position on the lower die holder of the press machine.

3. A method according to claim 2, further comprising moving the cam unit back and forth on a horizontal leg of the monolithic L-shaped module base, thereby adjusting the distance between the punch of the cam slider and the button die of the upright leg of the monolithic L-shaped module base in respect of the length of the punch.

* * * * *